United States Patent [19]

Dineen

[11] 3,964,356

[45] June 22, 1976

[54] PAPER WEB TRIMMING APPARATUS HAVING FEED BAND CHOPPER

[75] Inventor: John Joseph Dineen, Durham, N.H.

[73] Assignee: Moore Business Forms, Inc., Niagara Falls, N.Y.

[22] Filed: Dec. 16, 1974

[21] Appl. No.: 533,744

[52] U.S. Cl. ..... 83/302; 83/44; 83/408; 83/920

[51] Int. Cl.[2] ..... B26D 9/00

[58] Field of Search ..... 83/302, 408, 920, 39, 83/42, 43, 44, 301

[56] References Cited

UNITED STATES PATENTS

| | | | |
|---|---|---|---|
| 3,415,148 | 12/1968 | O'Brien | 83/302 |
| 3,739,667 | 6/1973 | Ernst | 83/302 |
| 3,774,485 | 11/1973 | Kercher | 83/408 |
| 3,831,502 | 8/1974 | Tokuno | 83/302 |

*Primary Examiner*—Donald R. Schran
*Attorney, Agent, or Firm*—Watson, Cole, Grindle & Watson

[57] ABSTRACT

In an apparatus for trimming a band of marginal feed holes from the marginal edge of a continuous paper web wherein the apparatus has a pair of rotary slitters for slicing the web parallel to its marginal edge and a tractor pin feed device for moving the web toward the rotary slitters, a web chopper is provided which includes a rotary chopper blade in cutting engagement with a rotary anvil for repeatedly chopping the web at its marginal edge. The chopper blade has an inner edge in alignment with the slitters so that the web may be chopped along its marginal edge during the feeding thereof into the slitters which serve to thereafter slit along the web to thereby separate the feed hole band from the web into short strips.

5 Claims, 5 Drawing Figures

PAPER WEB TRIMMING APPARATUS HAVING FEED BAND CHOPPER

BACKGROUND OF THE INVENTION

Field of the Invention Including Description of the Prior Art

This invention relates generally to a web handling apparatus, and more particularly to such an apparatus having tractor pins for feeding the web into marginal edge slitters and a web chopper for chopping the web at its marginal edge so as to effect a chopped feed hole band separated into short strips.

It is customary for continuous paper webs to have marginal feed holes along one or both marginal edges thereof to facilitate pin feeding of the web through a printer. After leaving the printer, the marginal feed holes are usually trimmed from the web before manifolding so that the customer will ultimately receive the paper product minus the punched feed holes. Trimming may be carried out on an apparatus having a pair of rotary slitters for slitting the web just inwardly of the feed holes as the web is fed into the slitters by a tractor pin feed device which engages the feed holes. Such a feed device is typically shown in U.S. Pat. No. 3,606,122 to Brewster et al and commonly owned herewith. The disclosure of such patent is specifically incorporated herein by reference in its entirety.

The feed band separated from the web at the marginal edge or edges thereof by the slitters is normally dropped into a waste receptacle in continuous form after which it is bundled or otherwise handled. These continuous feed tapes may be chopped up before bundling although this operation has been generally avoided because it is too costly and time consuming.

It has been found that, by chopping up the continuous tapes into lengths of approximately 4½ inches, several times the amount of chopped feed tapes can be collected in a single waste container as compared to the unchopped and continuous feed tapes. The savings in storage space and labor costs in handling the waste material can therefore be quite substantial if the feed tapes are chopped before being collected.

An apparatus for trimming the sides of sheets and chopping the scraps thereby formed is disclosed in U.S. Pat. No. 2,133,595 to Thomas. A pair of slitters are used for the trim operation and trim choppers are disposed downstream thereof. Endless belts in engagement with opposite sides of the side trim are provided for guiding the side trim into the choppers.

In U.S. Pat. No. 3,110,208 to Mitchell, Jr. et al and in U.S. Pat. No. 2,970,329 to Fitzgerald, devices are disclosed for trimming metal strips and shoe leather strips wherein slitting knives and chopping knives are disposed on a common belt.

In each of the aforementioned patents chopping means are not disclosed in combination with a continuous paper web trimming apparatus using a tractor pin feed device for supporting the web already chopped in the vicinity of its punched hole feed bands and for feeding the web toward rotary slitting knives. In Thomas endless belts are disposed between the slitting knives and the chopping knives to insure that the trim strips do not buckle or jam or otherwise get out of line before reaching the chopping knives. In both Fitzgerald and Mitchell, Jr., et al, the chopping and slitting operations take place simultaneously and are not separated as in the present invention with a tractor pin feed device lying therebetween.

SUMMARY OF THE INVENTION

It is therefore an object of this invention to provide a paper web trimming apparatus having a feed band chopper which effectively chops the web along its marginal edge inwardly of the feed holes after which the feed pin tractor device transfers the web toward the slitting knives which serve to slit along the web thereby separating the feed hole band from the web into short strips.

Another object is to provide such an apparatus wherein the chopping blade has an inner end in alignment with the slitting knives so as to effect a neat and clean trim cut as the slitters intersect the chopped cuts at their inner ends.

A further object of the present invention is to provide such an apparatus wherein the chopper comprises a rotary chopping blade in engagement with a rotary anvil having a plurality of grooves along its periphery. Each of the grooves is filled with an elastomeric material extending slightly outwardly of the pitch line or periphery of the anvil. The cutting blade engages with an edge of one of such grooves during each revolution thereof, and serves to successively chop the trim as it is supported at the cutting edge of the groove by the elastomeric material.

DESCRIPTION OF THE PREFERRED EMBODIMENT

Figure 1:
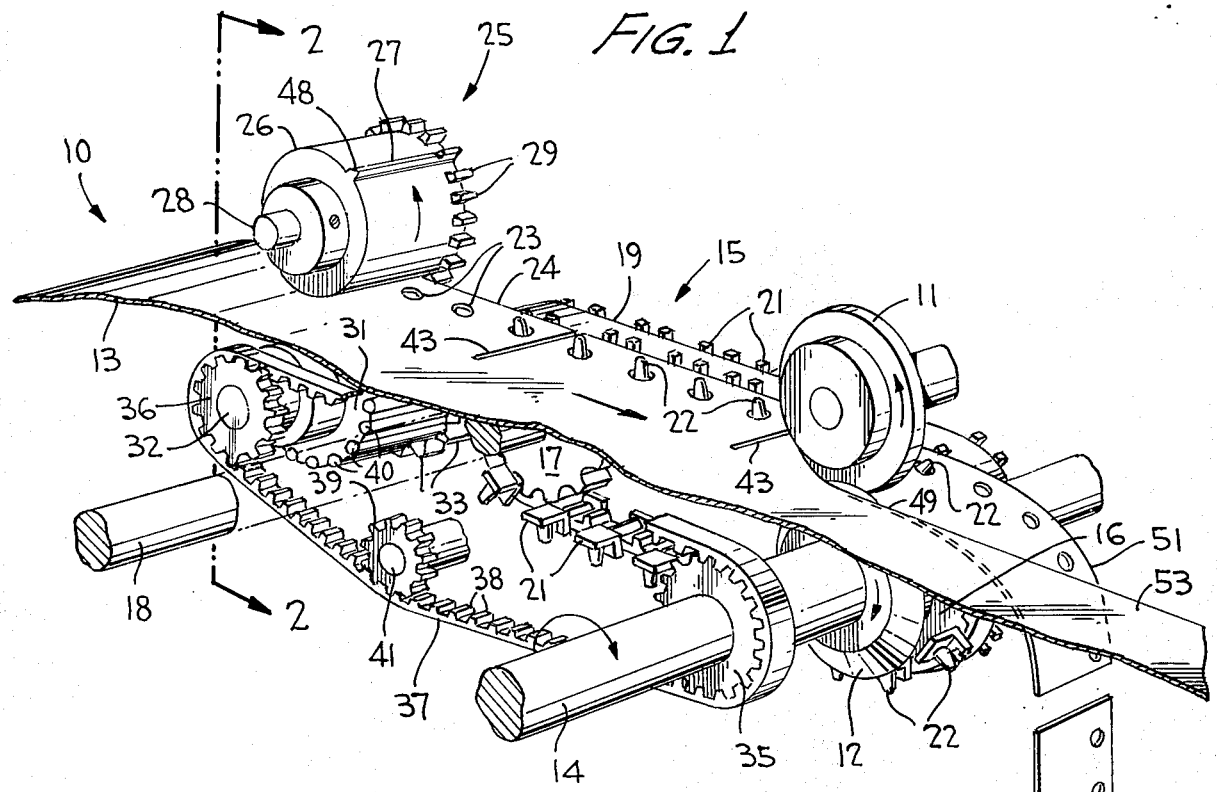
FIG. 1 is a perspective view of the paper web trimming apparatus having a feed band chopper in accordance with the present invention.

In the drawings wherein like reference characters refer to like and corresponding parts throughout the several views, the paper web trimming apparatus is generally designated 10 in FIG. 1 and comprises a pair of rotary slitters 11 and 12 in overlapping engagement with one another for slitting along a continuous paper web 13 in a manner which is not specifically described since rotary slitters of this type are commonplace in the art. Slitter disc 12 is fixedly mounted on a shaft 14 which is rotated in the direction of the arrow of FIG. 1 from a power source not shown. A tractor pin feed device 15 is typically included in a web trimming apparatus of this type for the purpose of moving the web toward the slitters. Feed device 15 is similarly constructed as in accordance with the aforementioned Brewster et al patent which includes a drive sprocket 16 mounted on shaft 14 for rotation therewith, and a driven spocket 17 spaced from the drive sprocket and mounted on a driven shaft 18. An endless conveyor 19 extends about sprockets 16 and 17 and is rotated in the normal manner together with the drive sprocket. A plurality of spaced feed elements 21 are mounted on the endless conveyor, each of these elements having an outwardly extending pin 22 engaging a punched hole 23 typically located along marginal edge 24 of the web.

A chopper generally designated 25 is located upstream of the tractor pin feed device and includes a rotary drum 26 having a chopping blade 27 on the periphery thereof disposed substantially traversely of the web. This drum is rotatable on its shaft 28 and has gear teeth 29 at one end thereof located outwardly of marginal edge 24 of the web. The chopper further comprises a rotary anvil 31 mounted for rotation on its shaft 32 (see also FIG. 4), the anvil likewise having gear teeth 33 at one end lying outwardly of marginal edge 24 of the web and in meshing engagement with gear teeth 29 of the cutter drum. The rotary anvil is fluted along its outer periphery as defined by a plurality of cutting grooves 34 each lying parallel to shaft 32.

A drive sprocket 35 is fixedly mounted on shaft 14 for rotation therewith, and a driven sprocket 36 is mounted on axle 32 of the rotary anvil. A drive belt 37 having facing ribs 38 extends about sprockets 35 and 36 and engages the sprocket teeth thereof so that, upon rotation of drive shaft 14, the rotary anvil is rotated in the same direction and effects rotation in an opposite direction of cutter drum 26 (see also FIGS. 4 and 5). A conventional idler sprocket wheel 39 may be provided for free rotation on its axle 41 and is adjustable, as by a cam and slot arrangement (not shown), in a vertical direction for the purpose of tensioning the drive belt in the normal manner.

Figure 3:
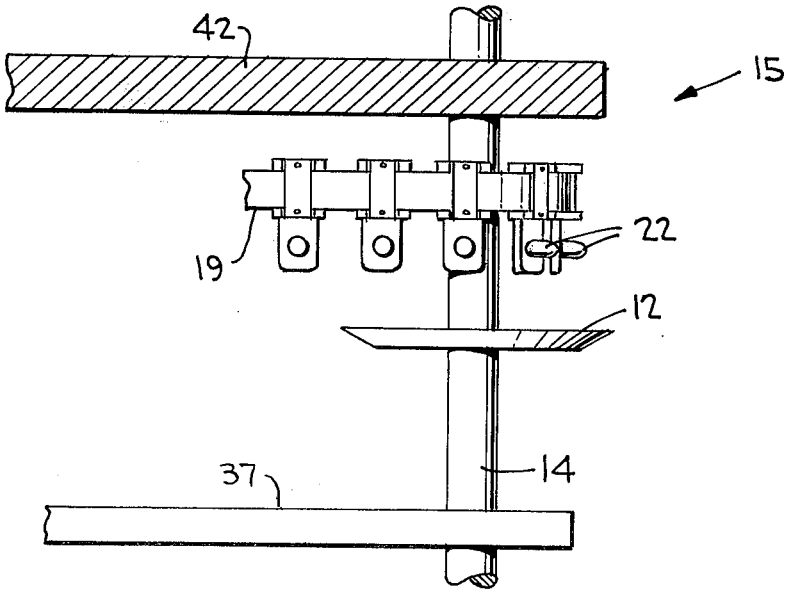
FIG. 3 is a top plan view showing a portion of the slitters, a tractor pin feed device and a drive belt as part of the FIG. 1 apparatus.

Although only one apparatus 10 is shown in FIG. 1, it should be noted that a complementary apparatus similar to that of FIG. 1 may be provided at the opposite side of the web for chopping and slitting the feed hole band from a web having rows of feed holes at opposite sides thereof. Also, shafts 14, 28, 32, 41 and the shaft (unreferenced) for slitter wheel 11 may be mounted in a suitable frame of the apparatus in a typical manner. Such frame structure is not shown in the interest of clarity although a portion of a frame side wall 42 is illustrated in FIG. 3. Moreover, the continuous paper web 13 is normally provided with transverse lines of weakening (not shown) to facilitate manifolding of the web as well as separation of the sheets interconnected along such lines. And elastomeric material 40 such as rubber and the like is disposed in each of the grooves 34 of the anvil for a purpose to be hereinafter described.

In operation, after web 13 leaves the printer, it is processed through apparatus 10 by the moving pin feed tractor device 15. Tractor pins 22 of the device engage with feed holes 23 which are normally provided along the web's marginal edge 24. As indicated hereinabove, another such pin feed tractor device 15 of another complementary apparatus 10 may be provided at the opposite side of the web for engagement with another row of feed holes provided at that side. As the web is pulled through the apparatus in the direction of the arrow shown in FIG. 1, blade 27 rotates together with its drum 26 and chops or cuts transverse slits 43 in the web at spaced intervals therealong. Blade 27 engages one of the grooves 34 of the rotary anvil as in the manner shown in FIGS. 4 and 5 once during each revolution of rotary drum 26. The cutting blade overlaps slightly with the rotary anvil at its cooperating groove 34 in the manner shown in FIG. 5 so as to effectively chop the web between cutting edge 44 of the chopping blade and cutting edge 45 of the groove. It has been found that an overlap at these edges of approximately 0.020 inches is adequate in effectively cutting of up to a four-part web, i.e., a four ply web. Also, it has been found that an average of 4½ inches between transverse slits 43 is adequate in providing the necessary short strips of the chopped feed tape.

Elastomeric material 40 may be secured in place in each of the anvil grooves 34 by a suitable adhesive or some other securing or anchoring means. However, the material should be free of the groove 34 wall adjacent cutting edge 45 thereof, and should protrude slightly outwardly of the pitch line or periphery of the anvil as shown in FIGS. 4 and 5.

Figure 4:
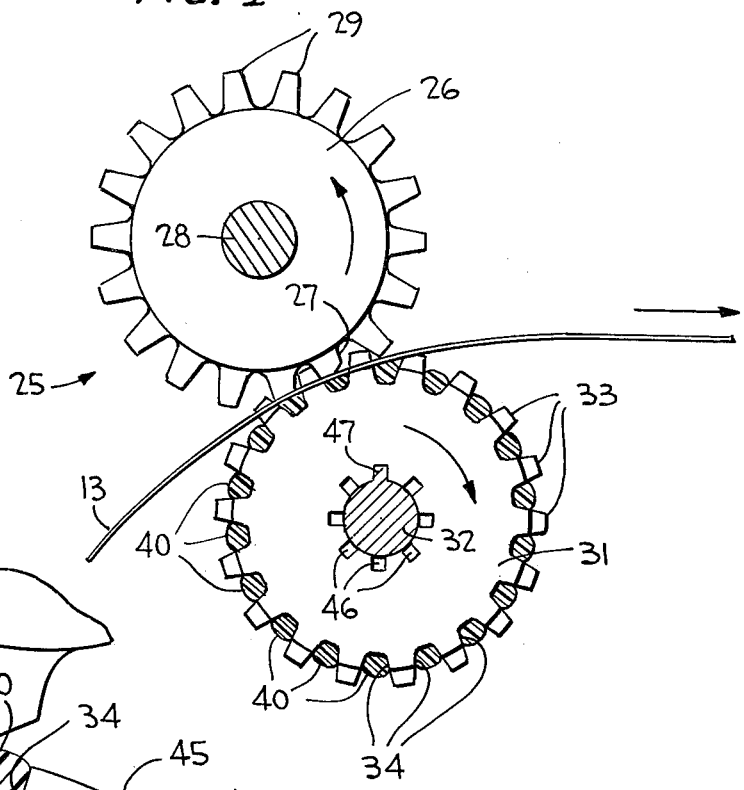
FIG. 4 is a side elevational view showing the details of the cooperating rotary cutting blade and rotary anvil.
Figure 5:
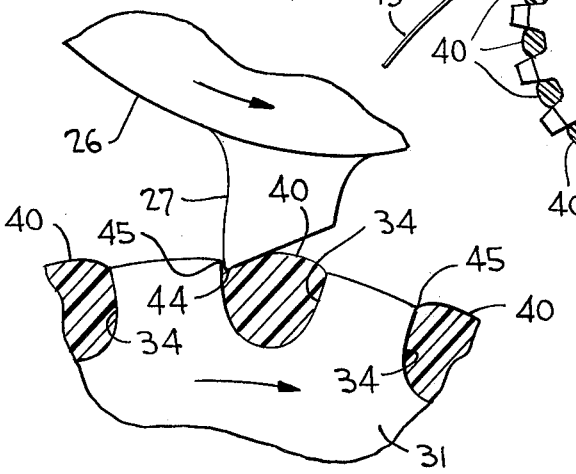
FIG. 5 is a detail view at a slightly enlarged scale showing the cutting blade in engagement with one of the grooves of the rotary anvil during rotation thereof.

Web 13 overlies several of these rubber pads 40 as the web proceeds through chopper 25 in the manner shown in FIG. 4. And, by reason of the slight protrusion of pads 40 outwardly of the anvil pitch line, the web is thereby supported in tension at cutting edge 45 to effect a clean and easy chopping action as edge 44 of blade 27 severs the web as it pushes against pad 40 (see FIG. 5). Pad 40 therefore prevents the web from being deflected into groove 34 and assists in the cutting action of the chopper. This has been shown to improve the performance and increase the reliability of the gear cutter type of trim disposal disclosed herein. Fine and repeated adjustment of cooperating cutting edges 44 and 45 is avoided by the present invention, it having been found that without such adjustment the web is pushed into groove 34 by the cutting blade to sometimes crush but not cut the web.

Although FIG. 4 shows the rotary drum including its gear teeth and the rotary anvil including its gear teeth as of substantially the same diameter, it should be pointed out that the rotary anvil can be of a smaller or larger diameter as compared to the rotary drum so as to rotate at a different speed as compared to the rotary blade. A cutting edge of one of the cutting grooves in any such arrangement must, of course, be designed to interengage with the cutting blade upon each revolution thereof. With such a differently sized rotary anvil, different grooves 34 thereof will engage with the cutting blade so that cutting edge 45 will have less tendency to dull prematurely as compared to a rotary anvil wherein only one of its cutting grooves interengages each time with the cutting blade. Moreover, rotary anvil 31 of FIG. 4 may be conveniently keyed onto shaft 32 as one of its key openings 46 provided for such purpose engages with key 47 of the shaft. This key may extend between the opposite sides of the rotary anvil so that, upon removal of the anvil so as to disengage the key, the anvil may be slightly rotated into a position of engagement between another of its key ways 46 and key 47. In such manner, another cutting groove 34 other than the one shown in FIGS. 4 and 5 will then engage with the cutting blade.

Figure 2:
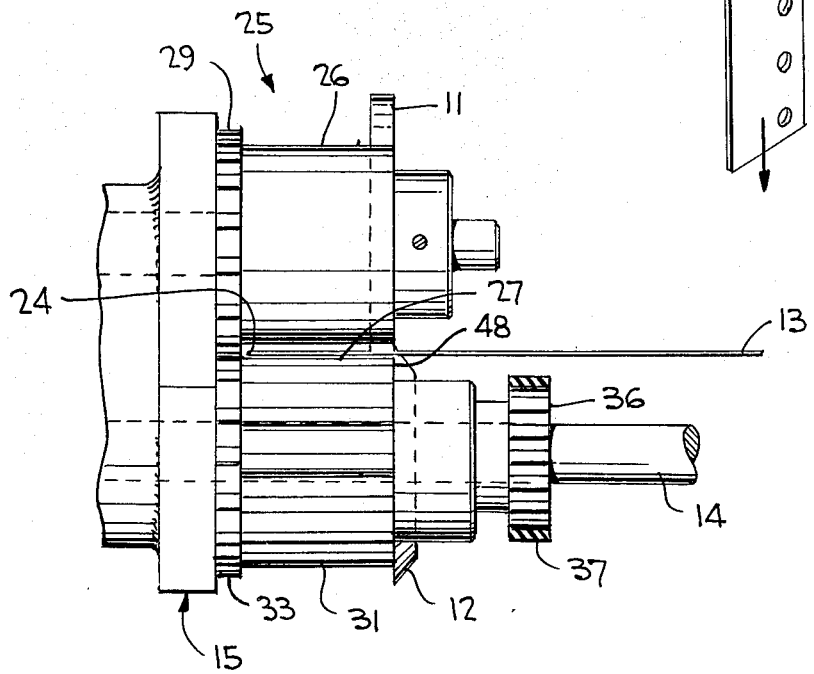
FIG. 2 is an end elevational view of the apparatus of FIG. 1 looking generally along line 2—2 thereof.

Blade 27 may be flat and parallel to its shaft 28 as shown, or it may be helical so as to slightly shear the web each time it engages with a cutting edge 45 of the anvil groove. Also, blade 27 has an inner edge 48 which is aligned with the slitters as shown in FIG. 2, in the direction of travel of the web. Therefore, upon movement of the chopped web into the slitters, the web is sheared along slit 49 parallel to marginal edge 24 and at the inner ends of transverse slits 43. The feed band or tape 51 is therefore separated from the web and, by reason of transverse slits 43, the band is chopped into strips 52 which fall into a suitably provided waste receptacle for collection. The remaining portion 53 of the web, now minus its feed band, is manifolded or otherwise collected in any normal manner.

From the foregoing, it can be seen that a chopper is provided in combination with a trim slitting apparatus so as to effectively and efficiently chop the web adjacent its marginal edge inwardly of its row of feed holes so that, as the web proceeds through the slitters, the feed band is thereby separated from the web into short strips. The conveyor belt of the tractor pin feed device effectively transfers the web in a forward direction of travel toward the slitters without regard to the transverse slits 43 provided in the web by the chopper. Since the feed band has not yet been separated from the web, the feed device is utilized as before in transferring the web forwardly. Therefore, separate guide means are not required for guiding a separated feed tape into a chopper as in the manner required by the aforementioned Thomas apparatus. The web, in accordance with the present invention, is chopped and then slit inwardly of its feed holes so that the feed band is separated into short strips by a simply operating, easy to manufacture and highly economical device.

Obviously, many modifications and variations of the present invention are possible in the light of the above teachings. It is therefore to be understood that within the scope of the appended claims the invention may be practiced otherwise than as specifically described.

What is claimed is:

1. In an apparatus for trimming a band of marginal feed holes from the marginal edge of a continuous paper web, comprising a pair of rotary slitters disposed for slitting the web parallel to its marginal edge, a web feed device having tractor pins for engaging the feed holes to transfer the web toward said rotary slitters, the apparatus including web chopping means located upstream of said feed device, said means having a chopper blade for repeatedly chopping the web from its marginal edge inwardly of the feed holes, and said blade having an inner end in alignment with said slitters, whereby the web is chopped along its marginal edge during the feeding thereof into said slitters which serve to thereafter slit along the web thereby separating the feed hole band from the web into short strips.

2. The apparatus according to claim 1, wherein said chopper blade is disposed for rotation and said chopping means includes a rotary anvil cooperating with said chopper blades.

3. The apparatus according to claim 2, wherein said rotary anvil is provided with a plurality of cutter grooves, said chopper blade engaging a cutting edge of one of said grooves upon each revolution of said blade, and a pad of elastomeric material being provided in each of said grooves, said material protruding slightly outwardly of the pitch line of said anvil.

4. A web chopping means in combination with an apparatus for trimming a band of marginal feed holes from the marginal edge of a continuous paper web, which apparatus includes a pair of rotary slitters disposed for slitting the web parallel to said marginal edge, and a web feed device having tractor pins for engaging the feed holes to transfer the web toward said rotary slitters, the chopping means including a rotary chopper blade in cutting engagement with a rotary anvil for repeatedly chopping the web from its marginal edge inwardly of the feed device, and said blade having an inner edge in alignment with said slitters, whereby the web is chopped along its marginal edge during the feeding thereof into said slitters which serve to thereafter slit along the web thereby separating the feed hole band from the web into short strips.

5. The web chopping means according to claim 4, wherein said rotary anvil is provided with a plurality of cutting grooves along its periphery, said blade engaging a cutting edge of one of said grooves upon each revolution thereof, and a pad of elastomeric material being provided in each of said grooves, said material protruding slightly outwardly of the pitch line of said anvil.

* * * * *